US008596002B2

(12) United States Patent
Andras

(10) Patent No.: US 8,596,002 B2
(45) Date of Patent: Dec. 3, 2013

(54) BASEMENT WATERPROOFING FLANGE

(75) Inventor: Stephen Andras, Westport, MA (US)

(73) Assignee: DNI Realty, LLC, Westport, MA (US)

( * ) Notice: Subject to any disclaimer, the term of this patent is extended or adjusted under 35 U.S.C. 154(b) by 703 days.

(21) Appl. No.: 11/471,800

(22) Filed: Jun. 21, 2006

(65) Prior Publication Data

US 2007/0294965 A1 Dec. 27, 2007

(51) Int. Cl.
*E04B 1/70* (2006.01)

(52) U.S. Cl.
USPC ..... 52/302.6; 52/169.5

(58) Field of Classification Search
USPC ..... 52/97, 169.5, 741.4, 900, 302.6
See application file for complete search history.

(56) References Cited

U.S. PATENT DOCUMENTS

| | | | | | |
|---|---|---|---|---|---|
| 608,861 | A | | 8/1898 | Horton | |
| 1,681,394 | A | | 8/1928 | Carlson | |
| 1,771,770 | A | | 7/1930 | Bruno | |
| 2,027,883 | A | * | 1/1936 | Ross | 52/481.1 |
| 2,833,138 | A | | 5/1958 | Kohn | |
| 2,899,771 | A | * | 8/1959 | Burris | 52/169.14 |
| 2,941,635 | A | * | 6/1960 | Harris | 52/634 |
| 3,283,460 | A | * | 11/1966 | Patrick | 52/274 |
| 3,304,672 | A | * | 2/1967 | Bakke | 52/169.5 |
| 3,344,569 | A | * | 10/1967 | Cotten | 52/287.1 |
| 3,713,539 | A | | 1/1973 | Thompson et al. | |
| 4,185,429 | A | | 1/1980 | Mendola | |
| 4,245,443 | A | * | 1/1981 | Beechen | 52/169.5 |
| 4,265,064 | A | * | 5/1981 | Parezo | 52/302.3 |
| 4,333,281 | A | * | 6/1982 | Scarfone | 52/169.5 |
| 4,660,333 | A | * | 4/1987 | Romer | 52/302.3 |
| 4,726,490 | A | | 2/1988 | Bonnema et al. | |
| 4,745,716 | A | * | 5/1988 | Kuypers | 52/169.5 |
| 4,837,991 | A | * | 6/1989 | Shaw | 52/98 |
| 4,845,910 | A | * | 7/1989 | Hanson et al. | 52/287.1 |
| 4,869,032 | A | * | 9/1989 | Geske | 52/169.5 |
| 4,943,185 | A | * | 7/1990 | McGuckin et al. | 405/45 |
| 4,983,069 | A | | 1/1991 | Florence | |
| 5,199,232 | A | * | 4/1993 | Chandler et al. | 52/169.5 |

(Continued)

FOREIGN PATENT DOCUMENTS

| | | | | | |
|---|---|---|---|---|---|
| GB | 2115855 | A | * | 9/1983 | E04B 1/70 |
| GB | 2155076 | A | * | 9/1985 | E04B 1/64 |
| JP | 02132258 | A | * | 5/1990 | E04D 3/369 |

OTHER PUBLICATIONS http://www.basementsystems.com/content/47/669/673/default.aspx (accessed Mar. 15, 2006).

(Continued)

*Primary Examiner* — Basil Katcheves
(74) *Attorney, Agent, or Firm* — Lando & Anastasi, LLP

(57) ABSTRACT

Flanges for use in basement waterproofing systems, and methods for their installation are disclosed. The flange may be installed at the interface between the foundation wall and footing at the sub-floor level. The flange comprises an angular portion extending from a vertical portion. The flange may also include a lip to facilitate installation, as well as one or more adhesive sections to enable the establishment of a closed system. The flange may be flexible and may include one or more tear-away features to allow the height of the flange to be altered. The flange may function in conjunction with a vapor barrier and other components of a waterproofing system, such as a drainage conduit and sump. The flange may be used in new installations as well as in retrofitting existing basements with a waterproofing system.

13 Claims, 3 Drawing Sheets

(56) References Cited

U.S. PATENT DOCUMENTS

| | | | | | |
|---|---|---|---|---|---|
| 5,367,842 | A | * | 11/1994 | Janesky | 52/169.5 |
| D354,821 | S | * | 1/1995 | Janesky | D25/138 |
| 5,398,471 | A | * | 3/1995 | Spagnolo | 52/412 |
| 5,501,044 | A | * | 3/1996 | Janesky | 52/169.5 |
| 5,529,436 | A | | 6/1996 | Meyers | |
| 5,630,299 | A | * | 5/1997 | Jackman et al. | 52/169.5 |
| 5,662,048 | A | | 9/1997 | Kralj et al. | |
| 5,694,723 | A | * | 12/1997 | Parker | 52/169.5 |
| 5,727,901 | A | | 3/1998 | Rennie et al. | |
| 5,765,323 | A | * | 6/1998 | Bevilacqua | 52/169.5 |
| 5,771,643 | A | * | 6/1998 | Parker | 52/169.5 |
| 5,784,838 | A | | 7/1998 | Phillips | |
| 5,794,388 | A | * | 8/1998 | Jackman | 52/169.5 |
| 6,027,283 | A | | 2/2000 | Schweinberg et al. | |
| 6,076,320 | A | * | 6/2000 | Butler | 52/294 |
| 6,170,095 | B1 | | 1/2001 | Zars | |
| 6,230,468 | B1 | * | 5/2001 | Klaus | 52/741.11 |
| D443,367 | S | * | 6/2001 | Janesky | D25/119 |
| 6,269,607 | B1 | * | 8/2001 | Ringlein et al. | 52/745.05 |
| 6,308,924 | B1 | | 10/2001 | Janesky | |
| 6,361,099 | B1 | | 3/2002 | McIntosh et al. | |
| 6,419,421 | B1 | | 7/2002 | Whitfield, Jr. | |
| 6,550,190 | B2 | * | 4/2003 | Ruiz et al. | 52/169.5 |
| 6,598,360 | B1 | | 7/2003 | Pratt | |
| 6,601,607 | B1 | * | 8/2003 | Pratt | 137/357 |
| 6,619,001 | B1 | * | 9/2003 | Pratt | 52/169.5 |
| 6,647,682 | B2 | | 11/2003 | Bishop | |
| 6,672,016 | B2 | * | 1/2004 | Janesky | 52/169.5 |
| 6,719,004 | B2 | | 4/2004 | Huber et al. | |
| 6,848,468 | B1 | | 2/2005 | Hsien | |
| 6,904,723 | B1 | * | 6/2005 | Moore et al. | 52/169.5 |
| 7,303,357 | B2 | | 12/2007 | Villarreal et al. | |
| 7,437,855 | B2 | * | 10/2008 | Locke et al. | 52/169.14 |
| 2002/0152696 | A1 | | 10/2002 | Ruiz et al. | |
| 2003/0115814 | A1 | | 6/2003 | Nielsen | |
| 2003/0177727 | A1 | * | 9/2003 | Gatherum | 52/302.6 |
| 2005/0198916 | A1 | * | 9/2005 | Janesky | 52/169.5 |
| 2006/0032158 | A1 | * | 2/2006 | Moule | 52/169.5 |
| 2006/0112653 | A1 | * | 6/2006 | Hogenson | 52/169.5 |
| 2007/0044396 | A1 | * | 3/2007 | Janesky | 52/169.5 |
| 2007/0068093 | A1 | * | 3/2007 | Grange et al. | 52/97 |
| 2007/0094952 | A1 | * | 5/2007 | Niemczyk | 52/169.5 |
| 2007/0175113 | A1 | * | 8/2007 | Moule | 52/169.5 |
| 2007/0294966 | A1 | * | 12/2007 | Andras | 52/169.5 |
| 2008/0078142 | A1 | * | 4/2008 | Andras | 52/741.3 |
| 2008/0104910 | A1 | | 5/2008 | Andras et al. | |

OTHER PUBLICATIONS http://www.basementsystems.com/images/WaterGuard_In_Progress.jpg (accessed Mar. 15, 2006).

http://www.basementsystems.com/content/47/71/default.aspx (accessed Mar. 15, 2006).

http://www.basementtechnologies.com/products/wraqua.html (accessed Mar. 15, 2006).

http://www.fasteel.com/WaterProofing.htm (accessed Mar. 8, 2006).

* cited by examiner

BASEMENT WATERPROOFING FLANGE

BACKGROUND OF THE INVENTION

1. Field of the Invention

At least one embodiment of the present invention relates generally to devices and methods for basement waterproofing and, more particularly, to improved flanges for use in conjunction with various basement waterproofing systems.

2. Discussion of Related Art

The potential for moisture in the basement of buildings is of ongoing concern to homeowners, building contractors, and structural engineers. Basement foundation footings are typically located several feet below ground level, and water may accumulate around the foundation as the groundwater level periodically rises, for example, due to rain or melting snow. As a result, hydrostatic pressure may build causing leakage through cracks in the footings, structural interfaces, and the floor. Concrete, typically used in the construction of foundations, attracts groundwater by sorption, and capillary forces in the concrete pores facilitate further penetration of the groundwater. Seepage of groundwater into a basement can cause significant structural damage, as well as promote the growth of harmful bacteria, such as iron bacteria. Furthermore, dangerous radon gas, and water vapors contributing to a high basement humidity level, can flow easily through the concrete pores.

Interior, sub-floor drainage systems, installed along the perimeter of a basement, have been used to address problems with moisture in basements. Such systems typically include a drainage conduit located along the interior perimeter of the basement to collect and convey groundwater to a sump for removal. A flange, positioned at the joint between the foundation wall and footing, may be used to help direct groundwater to the conduit. Traditional flanges are molded of plastic, and installed spaced apart from the wall in an open system to drain any wall seepage.

BRIEF SUMMARY OF THE INVENTION

In accordance with one or more embodiments, the invention relates generally to an improved basement waterproofing flange.

In accordance with one or more embodiments, the invention relates to a basement waterproofing flange comprising a vertical portion having a first distal end, a second distal end, and a first side between the first distal end and the second distal end, an angular portion extending from the first distal end of the vertical portion, configured to create a space at a joint between a foundation wall and a foundation footing upon installation of the flange, an adhesive section, positioned on the first side of the vertical portion, configured to create a closed system upon installation of the flange, and a tear-away feature, positioned along the vertical portion, configured to facilitate altering a height of the flange.

The flange may further include a lip extending from the second distal end of the vertical portion. The adhesive section may include a plurality of adhesive strips positioned on the first side of the vertical portion. The flange may still further include a plurality of tear-away features positioned along the vertical portion. The flange may be made from a polyvinyl chloride plastic material, and may be flexible. The flange may be 2 to 8 inches in height.

In accordance with one or more embodiments, the invention relates to a basement waterproofing system comprising a flange comprising a vertical portion, and an adhesive section positioned along a first side of the vertical portion, wherein the adhesive section is configured to be installed at a joint between a foundation wall and a foundation footing along a basement perimeter, and a drainage conduit configured to convey groundwater along the basement perimeter for extraction.

The system may further include a sump fluidly connected to the drainage conduit. The system may further include a vapor barrier disposed along the foundation wall. The adhesive section may be coupled to the vapor barrier.

In accordance with one or more embodiments, the invention relates to a process of waterproofing a basement comprising providing a vapor barrier along an interior surface of a foundation wall, sealing a flange against the vapor barrier along a perimeter of the basement at a joint between the foundation wall and a foundation footing to create a closed system, and providing a drainage conduit in close proximity to the foundation footing to convey groundwater to a remote location for extraction.

In the process, the step of sealing the flange may involve utilizing an adhesive section positioned on the flange. The process may further include applying a basement floor over the foundation footing and the drainage conduit. The process may still further include adjusting a height of the flange. The process may further include fluidly connecting the drainage conduit to a sump.

In accordance with one or more embodiments, the invention relates to a process of retrofitting a basement with a waterproofing system comprising exposing a joint between a foundation wall and a foundation footing, positioning a flange comprising an adhesive section at the joint along a perimeter of the basement, and installing a drainage conduit in close proximity to the foundation footing along the basement perimeter.

In the process, the step of positioning the flange at the joint may include sliding the flange between the foundation wall and an interior basement wall. Sliding the flange may involve utilizing a lip extending from a distal end of the flange. The process may further include sealing the flange against the foundation wall with the adhesive section to create a closed system. The process may still further include adjusting a height of the flange. The process may further include a step of fluidly connecting the drainage conduit to a sump.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which.

DETAILED DESCRIPTION OF THE INVENTION

Figure 1:
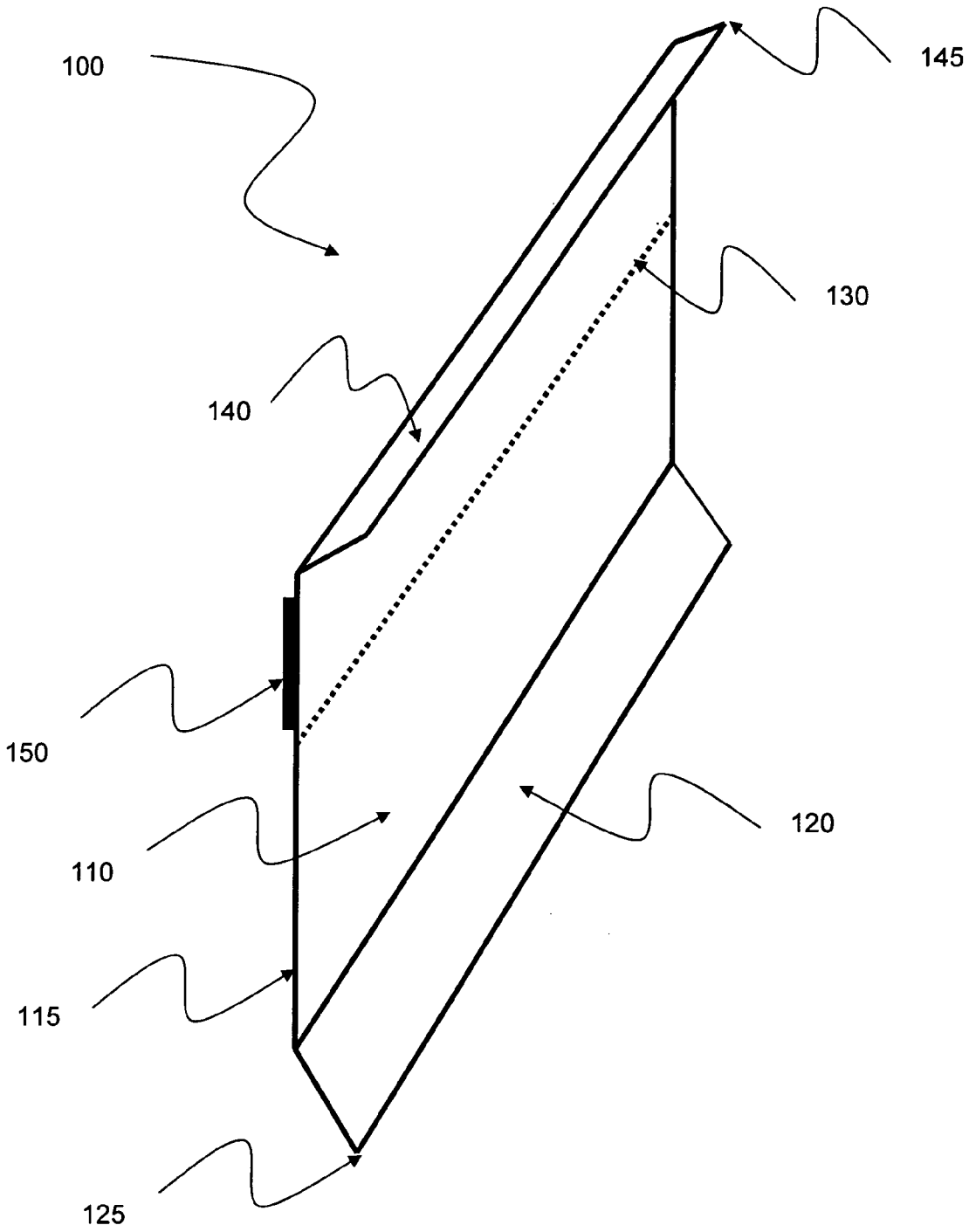
FIG. 1 illustrates a perspective view of a flange in accordance with one or more embodiments of the present invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to a flange for use in sub-floor basement waterproofing systems. The flange may be installed at the joint between the foundation wall and footing, around the perimeter of a basement. More specifically, the flange may be positioned so as to enclose the joint between the foundation wall and footing. The flange may be installed around the entire perimeter of the basement, or only a portion thereof as desired. The flange may be effective in directing groundwater to a drainage conduit positioned to collect and channel groundwater to, for example, a sump for removal.

The flange may be constructed of any material suitable for its intended purpose, such as a polyvinyl chloride (PVC) plastic. The flange material in at least one embodiment should be durable and generally compatible with groundwater, soil, concrete, and any minerals or chemicals with which it may come into contact. The dimensions of the flange may vary for different applications but, in general and without limiting the scope of the disclosure, a typical flange may range from 2 to 8 inches in height, and from 1/16 to 1/4 inches in thickness.

The flange may be flexible so as to facilitate installation in a variety of basement waterproofing applications. For example, the flexible flange of at least one embodiment may be bent and slid into position during a retrofit process, as discussed in greater detail below. The flexible nature of the flange also enables it to conform to a basement perimeter of any geometry, thus eliminating the need to join together different pieces to accommodate corners and other obstructions during installation. The flexible flange may be manufactured, such as by an extrusion process, in long pieces and may be rolled for compact storage and convenient transfer to a construction site. For example, the flange may be extruded as a continuous piece or source 100 to 150 feet in length using dies to shape the desired cross-sectional profile. The flange may be also manufactured in shorter and/or longer lengths to suit other applications.

During installation, a desired length of the flange may be cut from the continuous piece for use. Alternatively, multiple portions of flange may be seamed together to generate a required length. When joining is necessary, it may be desirable to overlap the pieces, such as by 4 to 8 inches, before sealing the joint with an adhesive, for example, a tape or caulk. This may add strength to the resulting joint and help prevent potential leakage at the seam.

Additional features of one embodiment of a flange of the present invention will now be described with reference to FIG. 1. In general, the flange 100 includes a vertical wall portion 110 and an angular portion 120. The vertical portion 110 is designed to rest substantially parallel to a foundation wall when installed. The vertical portion 110 may abut the foundation wall directly, or, when the flange is used in conjunction with an intermediate layer, such as a vapor barrier discussed further below, the vertical portion 110 may adjoin the intermediate layer. The vertical portion 110 may include a side 115, which is oriented towards the foundation wall when installed, and is substantially flat to rest flush against the foundation wall, vapor barrier, or other intermediate layer, without any gaps or spaces.

The angular portion 120 extends from a first end of the vertical portion 110 and is generally designed to slant away from the foundation wall when installed to create a zone for ground water collection at the interface of the foundation wall and footing. The angle at which the angular portion 120 is oriented relative to the vertical portion 110, as well as the distance that the angular portion 120 extends from the vertical portion 110, defines the zone and each may be separately optimized. For example, in some embodiments, the angular portion 120 may form a 45 degree angle relative to the vertical portion 110. Without being bound to any particular theory, the angular portion 120 may serve as a barrier to prevent groundwater originating at the joint between the foundation wall and footing from penetrating the basement floor. As part of a basement waterproofing system, the flange 100 with the angular portion 120 may aid in directing the groundwater to a drainage conduit. The angular portion 120 is generally oriented to slope in a downward direction, such that a distal end 125 of the angular portion 120 may rest on the foundation footing, or gravel deposited thereon, when the flange 100 is installed.

Some embodiments of the flange 100 may include one or more tear away features 130 along the vertical portion 110 to enable altering the overall height of the flange 100 when desired. For example, the height of the flange 100 may be shortened using the tear away feature 130 to ease installation in certain applications. The tear away feature 130 may also be used to remove a portion of the flange 100 after installation, such as a portion that may remain extending above the basement floor level. The tear away feature 130 may be formed integral to the flange 100 during molding or extrusion. Alternatively, the tear away feature 130 may be added subsequent to initial manufacture by, for example, a scoring or perforation process. In general, the tear away feature 130 can embody any structural modification which enables a tearing motion, or use of a tool, to easily and uniformly remove an undesired section of the vertical portion 110 without excessive force. Furthermore, the tear away feature 130 should generally be designed so as to maintain the overall structural integrity of the vertical portion 110, as it may be desirable to employ the entire original flange height without making use of the tear away feature 130 in many installation applications. Multiple tear away features 130 may be positioned along the vertical portion 110 for flexibility in application.

The flange 100 may also include a lip 140 extending from a second end of the vertical portion 110 to aid installation. The lip 140 is generally designed to slope in an upward direction, away from the foundation wall when the flange 100 is installed. Thus, a distal end 145 of the lip 140, and the distal end 125 of the angular portion 120, may extend in opposite directions. The angle at which the lip 140 is oriented relative to the vertical portion 110, and the distance that the lip 140 extends from the vertical portion 110, may be separately optimized to aid installation. For example, in retrofitting applications discussed further below, the lip 140 may be configured to facilitate sliding the flange 100 into position, such as with a rotational, or hooking motion. In some embodiments, the lip 140 may form a 45 degree angle relative to the vertical portion 110.

An adhesive section 150 may be applied to the side 115 of the vertical portion 110. The adhesive section 150 may function to attach the flange 100 to a foundation wall or intermediate layer, such as a vapor barrier, during installation. The adhesive section 150 may be applied uniformly along the entire length of the flange 100 to create a seal between the flange 100 and foundation wall or intermediate layer. The adhesive section 150 may extend across the full height of the side 115, or only a portion thereof. In some embodiments, multiple adhesive sections 150 may be positioned along the side 115 for flexibility in installation. The adhesive section 150 may be provided in any configuration and comprise any material capable of facilitating the aforementioned attachment. For example, the adhesive section 150 may comprise an adhesive strip of double-sided tape, glue or other adhesive. The adhesive section 150 may further comprise a protective layer capable of being removed to expose the adhesive material prior to attachment. The adhesive section 150 may be included during manufacture of the flange 100, or, alternatively, it may be applied on-site during installation.

Thus, the flange of at least one embodiment of the present invention may be installed to create a closed system wherein the flange is uniformly sealed against a foundation wall or intermediate layer around the perimeter of the basement. Without being bound by any particular theory, a closed system may virtually eliminate any flow path between sub-floor and above-floor levels. Such a closed system may aid in containing radon gas and bacteria at the sub-floor level. Additionally, the closed system may promote energy conservation, such as by alleviating the need to dehumidify the basement environment.

As mentioned above, the flange of the present invention may be used in conjunction with an intermediate layer positioned between the foundation wall and flange, such as a vapor barrier. In such a case, the flange may be sealed to the vapor barrier with the adhesive section 150, rather than directly to the foundation wall. The vapor barrier is typically mechanically fastened to cover the foundation wall, and the attachment may be enforced with an adhesive, such as a caulk. A vapor barrier may aid in preventing vapors from entering the basement, and may direct any water seepage in the foundation walls down to the sub-floor drainage system. Thus, the vapor barrier may serve to protect studs, sheetrock or paneling of interior basement walls, as well as to lower overall humidity levels by keeping water vapor from entering the basement environment. In general, any material with a perm rating of less than about 1.0 is considered a vapor retardant. Many kinds of vapor barriers are commercially available, and climate or other conditions may influence the selection of a vapor barrier for a particular application. The flange of the present invention may be used with all types of vapor barriers. During installation, as discussed in greater detail immediately below, the flange may be sealed against the vapor barrier. Beneficially, the flange may serve to protect the vapor barrier from certain minerals in the concrete, such as lime, which may otherwise degrade the vapor barrier over time.

Figure 2:
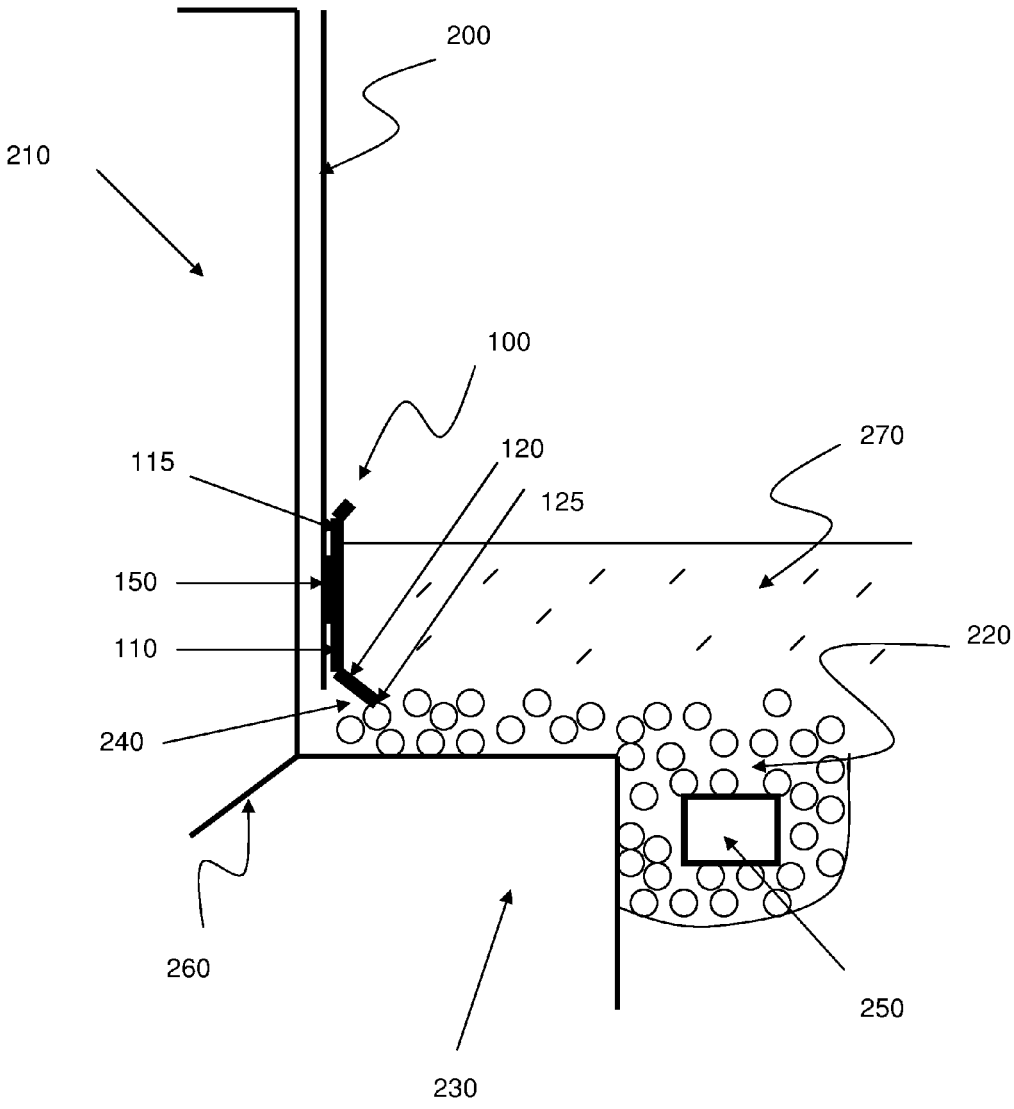
FIG. 2 illustrates a flange, in accordance with one or more embodiments of the present invention, installed in a new construction application.

The flange of the present invention may be installed using various techniques to suit different waterproofing applications. FIG. 2 illustrates the flange 100 installed in, for example, a new construction application. A vapor barrier 200 is attached across an interior surface of a foundation wall 210. The vertical portion 110 of the flange 100 abuts the vapor barrier 200 and the side 115 is sealed to the vapor barrier 200 with the adhesive section 150. As illustrated, the adhesive section 150 has been uniformly applied across a top portion of the side 115 along the entire length of the flange 100 to create a closed system between the flange 100 and the vapor barrier 200 around the entire perimeter of the basement. Alternatively, in other embodiments, the adhesive section 150 may be applied across a lower portion of the side 115, or multiple adhesive sections 150 may be applied as discussed above.

The distal end 125 of the angular portion 120 rests on crushed stones 220 which have been distributed over a foundation footing 230 to facilitate drainage of groundwater to a conduit 250, positioned adjacent to the foundation footing 230. Alternatively, in other embodiments, the conduit 250 may be positioned over the foundation footing 230 adjacent to the foundation wall 210. The angular portion 120 defines a zone 240 wherein any groundwater emanating from a joint 260 between the foundation wall 210 and the foundation footing 230 may collect for passage to the conduit 250.

After the flange 100 is positioned, a concrete flooring 270 may be laid over the crushed stones 220 and applied up to the flange 100, thus pushing the flange 100 against the vapor barrier 200. In this way, the crushed stones 220, as well as the overall structure of the flange 100, may both serve as barriers between the concrete flooring 270 and any groundwater present to protect against water damage. The concrete flooring may be laid, for example, 1 to 4 inches in thickness. In embodiments of the present invention wherein the flange 100 includes one or more tear-away features (not shown) as discussed above, the tear-away feature may be used to alter the height of the vertical portion 110 to customize and facilitate installation. Alternatively, the tear-away feature may be used after the concrete flooring 270 is applied to remove any excess portion of the flange 100 extending above the basement floor level.

Other components of an overall basement waterproofing system, in which the flange 100 of the present invention and the conduit 250 operate, may also be installed prior to laying concrete floor 270. Such components may include, for example, drain ports, sumps, and pump units. An interior basement wall framing may then be built on the concrete flooring 270 if desired, such as to create a finished basement. The embodiment discussed with reference to FIG. 2 may also be used, for example, in a retrofit application where any existing interior basement walls and concrete flooring are first removed prior to installation of a waterproofing system.

Figure 3:
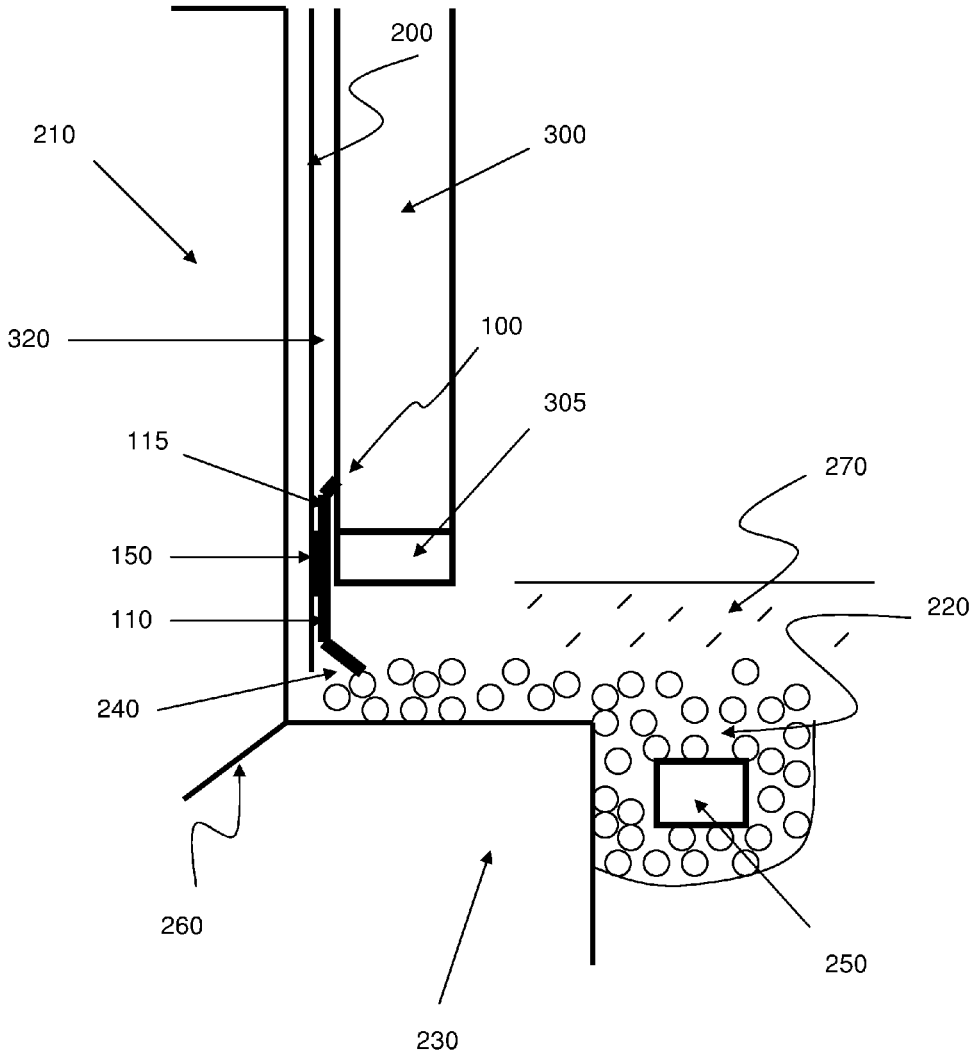
FIG. 3 illustrates a flange, in accordance with one or more embodiments of the present invention, installed in a retrofit construction application.

FIG. 3 illustrates the flange 100 in an alternative embodiment, such as a retrofit application where it is desirable to leave interior basement walls 300 intact during installation of a waterproofing system around the perimeter of a basement. In this case, a portion of the concrete flooring 270 is removed around a wall bottom plate 305 to expose the joint 260 and the footing 230, and to allow access to a space 320 between the foundation wall 210 and the basement wall 300. In the illustrated example, the vapor barrier 200 had previously been attached to the foundation wall 210, but the vapor barrier 200 may be absent depending on the retrofit construction site involved. The flange 100 is then slid into position between the vapor barrier 200 and the basement wall 300, facilitated by the lip 140 and the flexible nature of the flange 100. The adhesive section 150 may be used to create a closed system but this may not be possible, depending in part on available access to the space 320. The crushed stones 220, such as three-quarter inch crushed stones, are distributed over and to the side of the footing 230. The conduit 250 may then be placed among the crushed stones 220 to the side of the footing 230 in order to facilitate drainage of groundwater as part of an overall waterproofing system. In other embodiments, the conduit 250 may be positioned over the foundation footing 230 adjacent to the foundation wall 210. Other components of the waterproofing system may also be installed at this point in the process. The portion of the concrete floor 270 that was originally removed may then be replaced, to complete the retrofit installation.

Other embodiments of the flange of the present invention, and methods for its installation and use, are envisioned beyond those exemplarily described herein. As used herein, the term "plurality" refers to two or more items or components.

The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is:

1. A process of waterproofing a basement, comprising:

providing a vapor barrier along an interior surface of a foundation wall to substantially cover the interior surface of the foundation wall with the vapor barrier;

attaching the vapor barrier along the interior surface of the foundation wall with a sealant or a caulk;

applying a flange substantially flat against the vapor barrier, without any gaps or spaces, along a perimeter of the basement at a joint between the foundation wall and a foundation footing;

sealing the flange against the vapor barrier to create a closed system substantially eliminating any flow path between sub-floor and above-floor levels upon application of a basement floor over the foundation footing;

creating a zone for ground water collection at an interface of the foundation wall and the foundation footing with the flange; and providing a drainage conduit in close proximity to the foundation footing to convey groundwater to a remote location for extraction.

2. The process of claim 1, wherein the step of sealing the flange involves utilizing an adhesive section positioned on the flange.

3. The process of claim 1, further comprising a step of applying a basement floor over the foundation footing and the drainage conduit.

4. The process of claim 3, wherein applying a basement floor over the foundation footing and the drainage conduit comprises applying the basement floor up against the flange.

5. The process of claim 1, further comprising a step of adjusting a height of the flange.

6. The process of claim 1, further comprising a step of fluidly connecting the drainage conduit to a sump.

7. The process of claim 1, wherein creating the zone comprises positioning the flange against the vapor barrier such that an angular portion of the flange is generally oriented to slope in a downward direction away from the foundation wall.

8. The process of claim 1, wherein a top surface of the foundation footing has a proximate edge adjacent the foundation wall and a distal edge away from the foundation wall, and wherein a bottom portion of the flange is positioned closer to the proximate edge than to the distal edge of the foundation footing.

9. The process of claim 1, further comprising applying a layer of crushed stone on the foundation footing to facilitate drainage of water to the conduit, and resting a portion of the flange on the crushed stone.

10. A process of waterproofing a basement, comprising:

providing a vapor barrier along an interior surface of a foundation wall to substantially cover the interior surface of the foundation wall with the vapor barrier;

attaching the vapor barrier along the interior surface of the foundation wall with a sealant or a caulk;

resting a flange substantially flat against the vapor barrier, without any gaps or spaces, along a perimeter of the basement at a joint between the foundation wall and a foundation footing;

creating a closed system substantially eliminating any flow path between sub-floor and above-floor levels upon application of a basement floor over the foundation footing by sealing the flange against the vapor barrier;

creating a zone for ground water collection at an interface of the foundation wall and the foundation footing with the flange; and providing a drainage conduit in close proximity to the foundation footing to convey groundwater to a remote location for extraction.

11. The process of claim 10, wherein creating a zone for ground water collection at an interface of the foundation wall and the foundation footing comprises positioning the flange against the vapor barrier such that an angular portion of the flange is generally oriented to slope in a downward direction away from the foundation wall.

12. The process of claim 10, wherein a top surface of the foundation footing has a proximate edge adjacent the foundation wall and a distal edge away from the foundation wall, and wherein a bottom portion of the flange is positioned closer to the proximate edge than to the distal edge of the foundation footing.

13. The process of claim 10, further comprising applying a layer of crushed stone on the foundation footing to facilitate drainage of water to the conduit, and resting a portion of the flange on the crushed stone.

* * * * *